United States Patent [19]

Angsten

[11] Patent Number: 4,509,745

[45] Date of Patent: Apr. 9, 1985

[54] WEIGHT LIFTING DEVICE

[76] Inventor: Gregory S. Angsten, 151 South St., Crystal Lake, Ill. 60014

[21] Appl. No.: 389,719

[22] Filed: Jun. 18, 1982

[51] Int. Cl.[3] ..... A63B 21/00

[52] U.S. Cl. ..... 272/130; 272/118; 272/134

[58] Field of Search ..... 272/130, 143, 93, 76, 272/73, 118, 117, 134

[56] References Cited

U.S. PATENT DOCUMENTS

| | | | |
|---|---|---|---|
| 2,825,563 | 3/1958 | Lawton | 272/130 |
| 4,183,520 | 1/1980 | Chase | 272/130 |
| 4,227,689 | 10/1980 | Keiser | 272/130 |
| 4,357,010 | 11/1982 | Telle | 272/130 X |

*Primary Examiner*—Richard J. Apley
*Assistant Examiner*—William R. Browne
*Attorney, Agent, or Firm*—Mathew R. P. Perrone, Jr.

[57] ABSTRACT

A weight lifting device includes a frame having a weight stack secured to the frame, a force applicator secured to the frame and connected to the weight stack by a hydraulic connector, so that a person, who applies a muscular force to the force applicator, activates the hydraulic connector moves the weight stack and exercises the muscles. The weight stack is connected through a hydraulic system to a force applicator which includes a fluid contained cylinder that has a reciprocating piston that is acted upon by a user to cause fluid to act on and lift a plurality of stacked weight.

7 Claims, 7 Drawing Figures

Fig. I
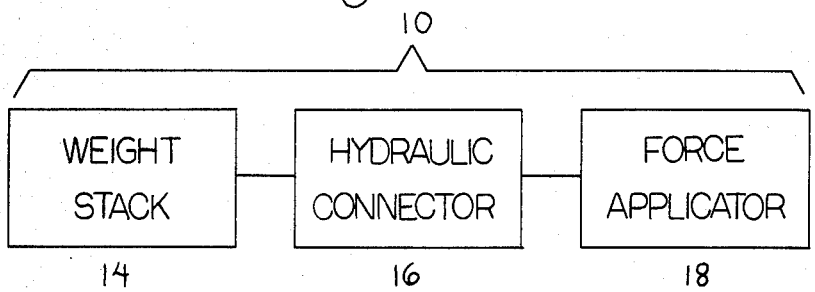
Fig. II
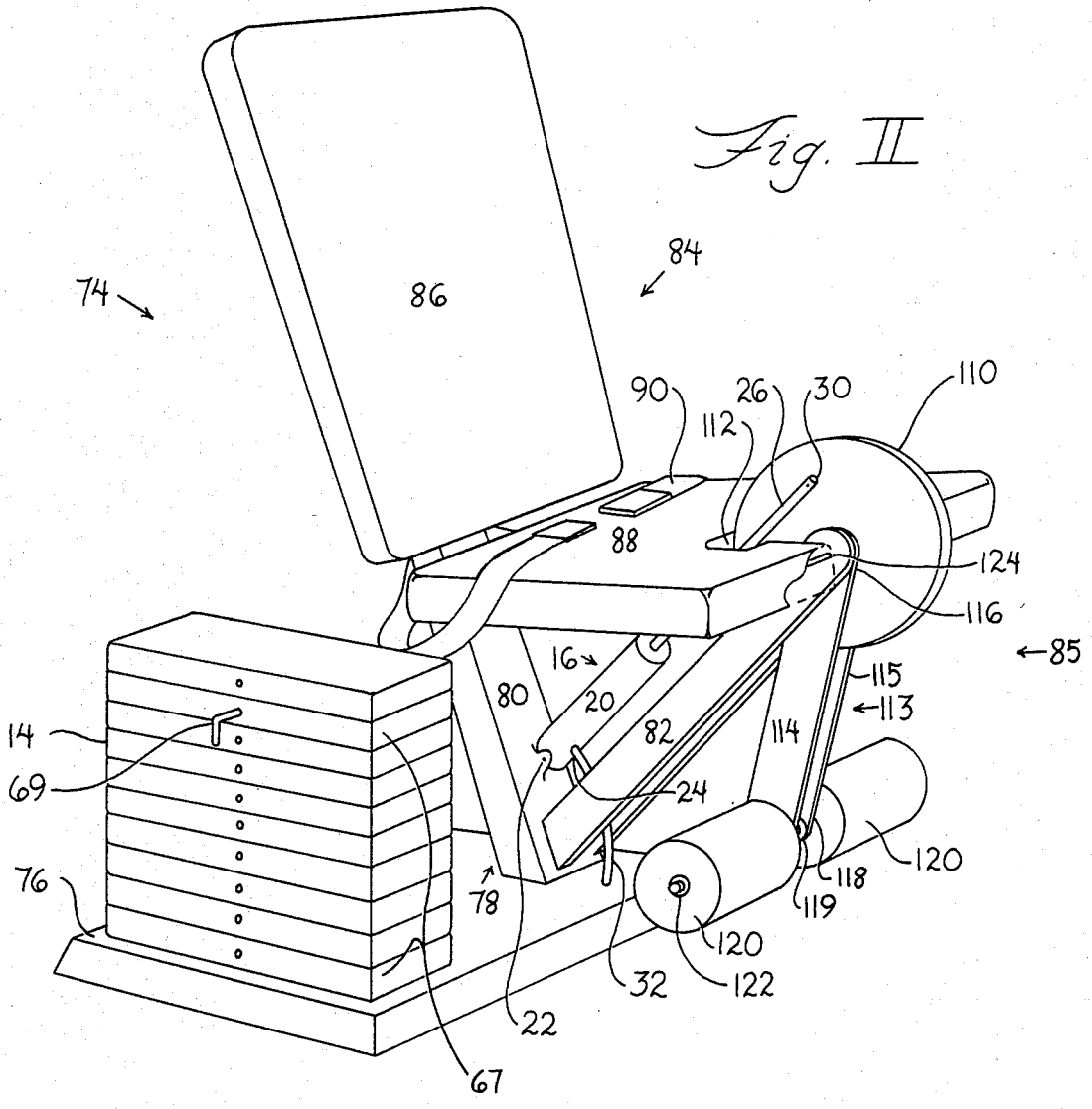

Fig III
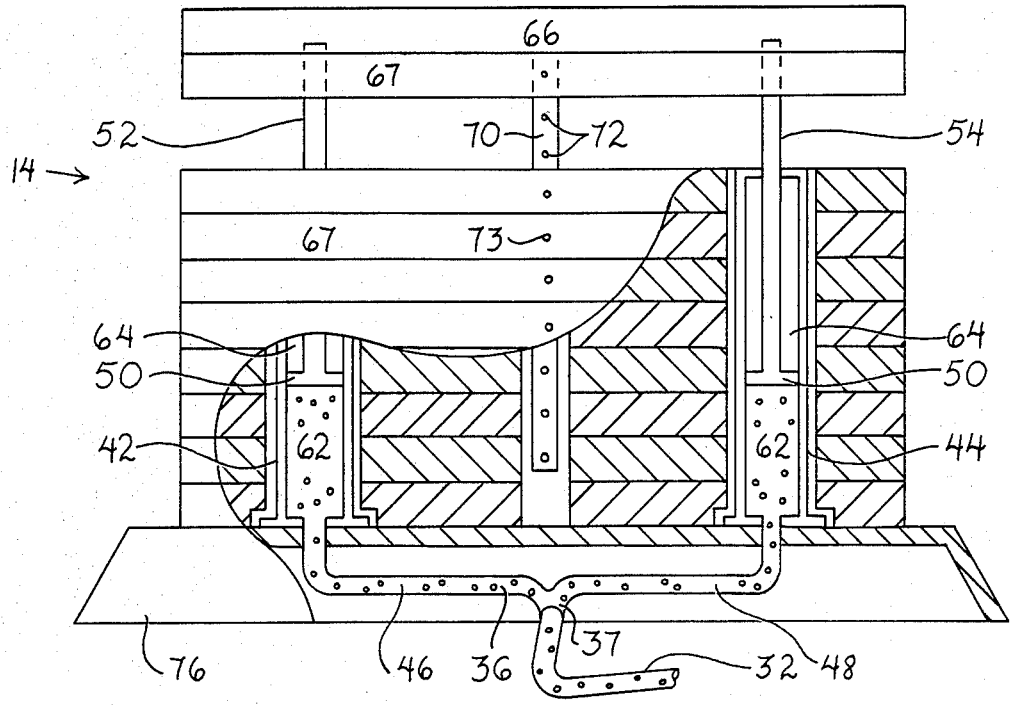
Fig. IV
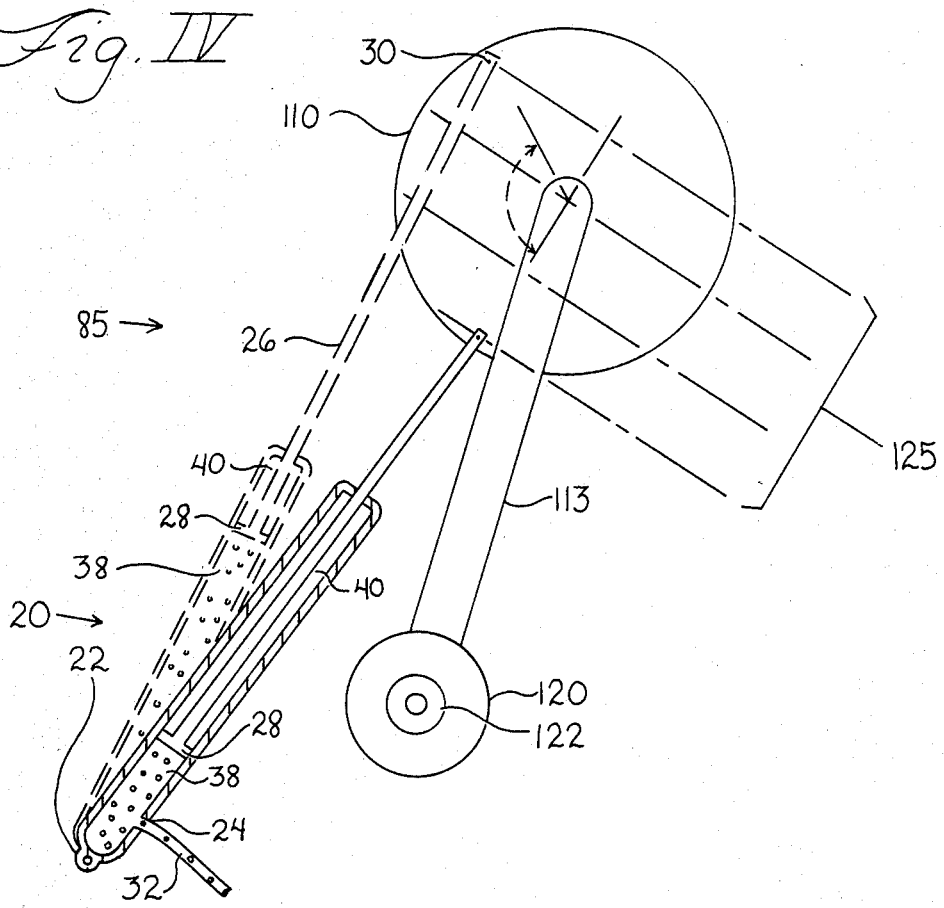

Fig. V
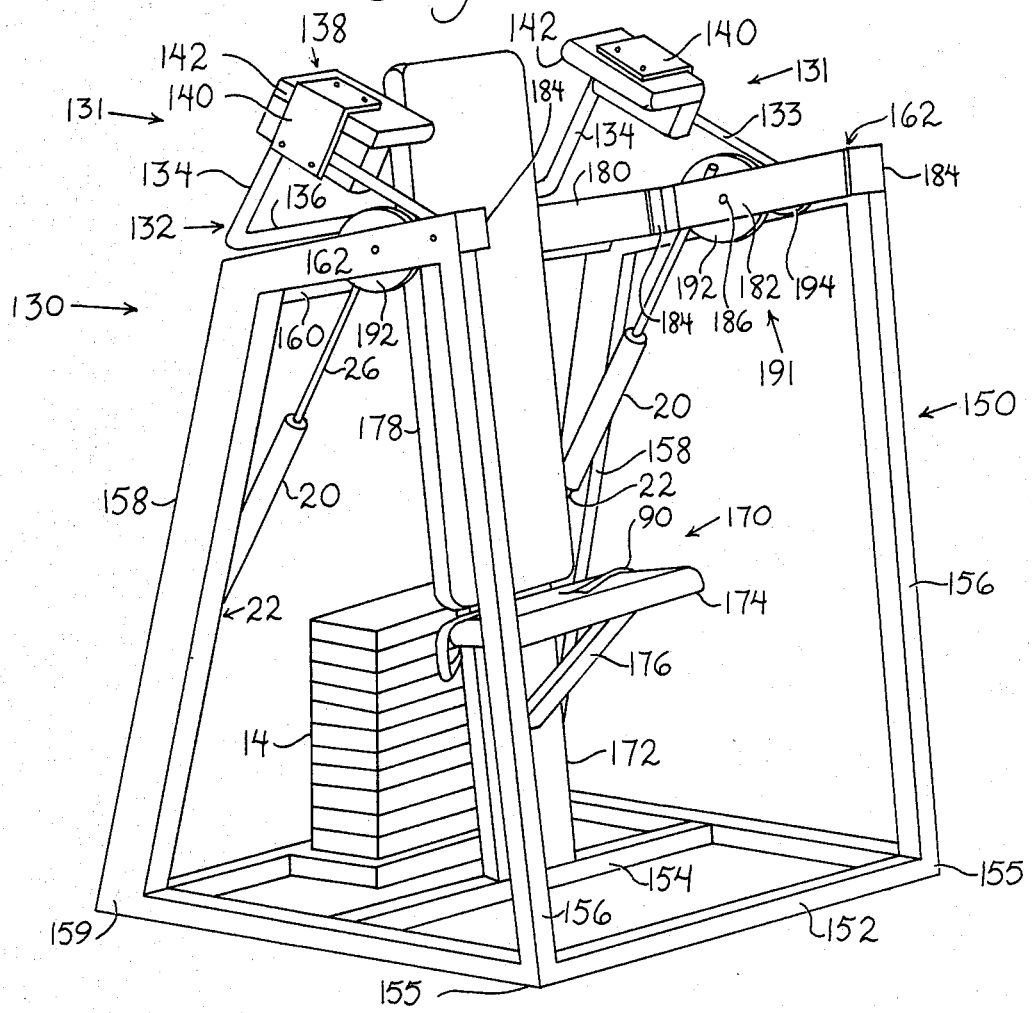
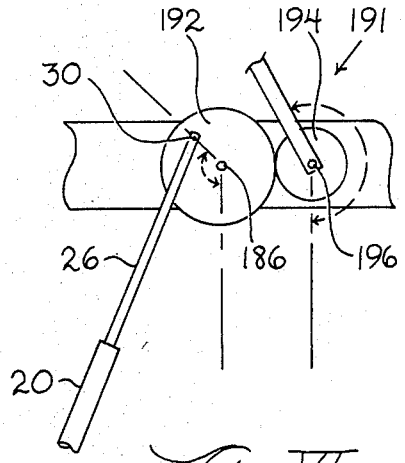
Fig. VI
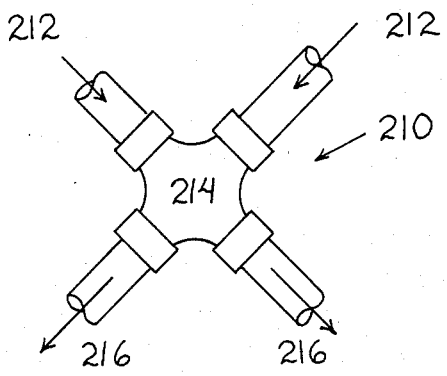
Fig. VII

WEIGHT LIFTING DEVICE

BACKGROUND OF THE INVENTION

This invention relates to an exercise device and more particularly to an exercise device having a force applicator connected to a variable weight stack by means of a closed, hydraulic circuit.

Physical fitness has great importance for the human race—for the caveman, as a matter of life and death; and for today, as a contribution to the basic well-being of a person. The physically fit person can endure stress more efficiently and feel better while so doing. Physical fitness is also related to mental conditioning. For example, a chess player strives to be in good physical condition as a necessity before engaging in the serious competition of chess.

There are also more standard reasons to be in good physical condition. A person in good physical condition feels better and looks better than a person who is not in good condition.

Now there are studies which have determined that certain groups of muscles will develop in certain ways. With such interest in physical fitness is a corresponding interest in developing devices to assist in attaining the appropriate degree of physical fitness. These devices have an application in the science of kinesiology.

From the studies in kinesiology, it is known that to best train, tone or otherwise improve a group of muscles, a variable resistance is best applied over the full range of muscle function. This variable resistance is applied so that the most resistance is achieved at the high leverage points of the muscle. This is an especially critical training improvement for professional athletes and others who depend on physical skill for their livelihood.

Weight training with barbells is a well-known method of strengthening, toning or otherwise training muscles. However, such training can be inefficient. Much time is spent in changing weights rather than exercising. Also, it is quite easy to improperly vary the exercise and not exercise the required group of muscles. Furthermore, the full range of the muscle is not exercised in all cases when using a barbell. There are certain points of a barbell exercise which provide no resistance for the muscle or muscles involved, and hence are not as efficient in the working of the muscles.

A real danger in weightlifting occurs when a person loses control of the weight being lifted. Such loss of control can injure the lifter as well as persons in the vicinity of the lifter.

Also, in weight lifting, a variation in the lifting style can avoid exercising the muscles for which the particular exercise was designed. This variation circumvents the purpose of the exercise.

One attempt to overcome these problems involves the use of hydraulic exercise devices having an adjustment to restrict the flow of hydraulic fluid, thereby creating resistance without the use of a weights. The only problem solved in this fashion involves the changing of weights. The other standard problems of weightlifting still exist. Furthermore, the hydraulic factor can be easily overcome by moving with extreme slowness and avoiding the required strain and testing of the muscles as desired.

Appropriate devices are known which overcome the problems inherent in weight training. Simpler devices use a direct connection between an adjustable weight stack and a force applicator, which minimizes and simplifies the problems of changing weights. With such a direct connection, however, the problems of not exercising the proper group of muscles and not applying resistance over the full range of the muscle together with other problems still remain.

More complicated devices solve the problems of exercising the proper group of muscles by using a system of chains, gears, and cables to connect various force applicators to a variable weight stack. In this manner, resistance can be applied over the entire range of the muscle.

The more complicated devices cause a number of problems. Firstly, they are bulky and require a substantial amount of room for proper operation. Secondly, the cams, chains and cables, and gears require substantial maintenance and lubrication. The chains and cables have a tendency to stretch and upset the balance of the machine, which can result in the proper group of muscles not being exercised. Additionally, the substantial number of parts used, which leads to the bulkiness, prevents the device from having a plurality of uses. One of the most significant problems of the complicated devices is the cost.

Thus, it may be seen that there are many problems to be solved in the field of exercise devices.

SUMMARY OF THE INVENTION

Therefore, it is an object of this invention to provide a device which contributes to physical fitness.

It is a further object of this invention to provide a device which can assist a person in stress endurance.

Still a further object of this invention is to provide a device which assists in the correct training of muscles according to the principles of kinesiology.

Yet a further object of this invention is to provide a device which assists persons depending on physical skill for their livelihood.

Also an object of this invention is to provide a device which avoids the dangers of weightlifting.

Another object of this invention is to provide a device which prevents the circumventing of the designed exercise.

Yet another object of this invention is to provide a device which avoids the use of chains, cables, and gears in an exercise device.

Still another object of this invention to provide a method which contributes to physical fitness.

It is a further object of this invention to provide a a method which can assist a person in stress endurance.

Still a further object of this invention is to provide a method which assists in the correct training of muscles according to the principles of kinesiology.

Yet a further object of this invention is to provide a method which assists persons depending of physical skill for their livelihood.

Also an object of this invention is to provide a method which avoids the dangers of weightlifting.

Another object of this invention is to provide a method which prevents the circumventing of the designed exercise.

Yet another object of this invention is to provide a method which avoids the use of chains, cables, and gears in an exercise method.

These and other objects of this invention, which will become apparent by considering the specification and claims herein as a whole, are met by providing an exercise device including a force applicator secured in operable fashion to a variable weight by a hydraulic connector.

BRIEF DESCRIPTION OF THE DRAWINGS

FIG. I is a block diagram of a generic exercise device 10 of this invention.

FIG. II is a perspective view of leg thrust device 74 within the scope of generic exercise device 10.

FIG. III is a partial cutaway view of weight stack 14.

FIG. IV is a closeup of hydraulic cylinder 20 connected to wheel 110.

FIG. V is a perspective view of torso developer 130 based generic exercise device 10.

FIG. VI is a side view of gear assembly 191 used in torso developer 130.

FIG. VII is a close-up view of cross connector 210 used in torso developer 130.

Throughout the Figures of the drawings, where the same part appears in more than one Figure of the drawings, the same number is assigned thereto.

DESCRIPTION OF THE PREFERRED EMBODIMENTS

An exercise device having a force applicator connected to a weight stack by a hydraulic connector provides for a less expensive manner for accomplishing the desired purpose of exercise while at the same time consuming less usable space and requiring less maintenance.

As shown in block diagram form in FIG. I, exercise device 10 has weight stack 14 connected to force applicator 18 by hydraulic connector 16. It is the structure of force applicator 18 which determines the actual structure of device 10 and the group of muscles being exercised. Thus, variations in force applicator 18 with corresponding adjustments in structure result in a device based on device 10, for the exercise of muscles.

Referring now to FIG. II and FIG. III, hydraulic connector 16 includes hydraulic cylinder 20, having pivot end 22 pivotally secured in standard fashion to base pillar 80. An outlet 24 in cylinder 20 is adjacent pivot end 22. At the other end of hydraulic cylinder 20 is force rod 26.

As shown in FIG. IV, force rod 26 has at one end thereof a sealing plunger 28 within hydraulic cylinder 20, and at the other end thereof a wheel end 30 rotatably secured to secured to wheel 110. Sealing plunger 28 and a variable part of force rod 30 are slideably mounted within hydraulic cylinder 20. Plunger 28 serves to divide hydraulic cylinder 20 into fluid chamber 38 communicating with outlet 24 and an empty chamber 40. The offsetting of wheel end 30 from the center of wheel 110 provides a camming action, which achieves a variable resistance over the range of the muscle group being exercised.

Referring now to FIG. I, FIG. II, FIG. III, and FIG. IV, it becomes clear that hose divider 36 provides a link for connecting hydraulic connector 16 to weight stack 14—especially in leg thrust device 74. Hose 32 is connected at one end to outlet 24 and at the other end thereof to hose divider 36 at hose divider base 37. Hose divider 36 connects hose 32 to first weight stack hydraulic cylinder 42 and second weight stack hydraulic cylinder 44, because hose divider base 37 branches into first divider arm 46 leading to first weight stack cylinder 42, and second divider arm 48 leading to second weight stack cylinder 44.

As shown in FIG. III, within first weight stack cylinder 42 is first weight rod 52. Similarly, second weight rod is within second weight stack cylinder 44. Each of first weight rod 52 and second weight rod 54 has at one end thereof a weight plunger 50. Weight plunger 50 serves for first weight cylinder 42 and second weight cylinder 44 in the same fashion as force plunger 28. Weight plunger 50 divides first hydraulic weight cylinder 42 and second hydraulic weight cylinder 44 into a weight fluid chamber 62 and a weight void chamber 64.

All hydraulic connections are capable of providing a durable, sealed hydraulic sytems for the disclosed purposes. In this fashion, hydraulic connector provides an efficient manner of transferring the force applied to force applicator 18 or any force applicator to weight stack 14. Such transfer is accomplished efficiently with minimal loss due to friction or other problems, while desired exercise is achieved. Thus, it may be seen that the weight stack 14 provides the resistance for setting the exercise force, while the hydraulic connector 16 is merely a transfer mechanism.

FIG. II depicts a leg extension device 74 within the scope of exercise device 10. Leg extension device 74 is designed to strengthen the frontal thighs or quadriceps.

Leg extension device 74 includes base 76 having chair support 78 secured thereto. Chair support 78 includes base pillar 80 and support pillar 82. Base pillar 80 is secured at one end thereof to base 76 and at the other end thereof to chair 84. Support pillar 82 is secured at one end thereof to base pillar 80 adjacent base 76 and at the other end thereof to leg thrust force applicator 85 in seat 88 of chair 84. Belt 90 is secured to chair 84 to hold the user of leg extension device 74 in the proper position and assure the proper use thereof, and proper exercise for the muscles sought to be exercised. Chair 84 also has a chair back 86.

Wheel 110 forms a part of leg thrust force applicator 85 and is received in a front portion of seat 88 at wheel notch 112, as is leg thrust force applicator 85. Leg thrust force applicator 85 further includes force bar 113, which in turn, is secured by welding or other suitable fashion at wheel end 116 to the center of wheel 110 in a fixed fashion. Force bar 113 includes a first force piece 114 and a second force piece 115 securely mounted on opposite sides of wheel 110. First force piece 114 and second force piece 115 are symmetrical.

Foot end 118 of force bar 113 is opposite wheel end 116 with first force piece 114 and second force piece 115 being separated by spacer 119 therebetween at foot end 118. Foot supports 120 are bolted to foot end 118 and spacer 119 by foot support nut and bolt arrangement 122 or are secured in another suitable fashion to thereby complete leg thrust force applicator 85.

Wheel end 116 and wheel 110, while fixedly secured to each other, are rotatably secured to wheel axle 124. Wheel axle 124 is secured at wheel notch 112 in seat 88 in a standard fashion so that wheel 110 is perpendicular to seat 88.

In FIG. IV, a close-up of wheel 110 and its connection to hydraulic cylinder 20 is shown. By appropriate segmentizing wheel 110 with segment lines 125, and attaching wheel end 30 of hydraulic cylinder 20 to wheel 110 at a selected segment line 125, appropriate resistance at the various leverage points of muscle or group of muscles is achieved by the resulting camming action.

FIG. V is an upper torso exercise device 130 based on device 10. The basic difference between upper torso device 130, device 10 and leg extension device 74 is found in the various force applicators and corresponding support structure. Upper torso force applicator and the support structure therefor are the basic differences between upper torso exercise device 130 and leg extension device 74.

Such a distinction becomes readily apparent when considering the similarities and differences between upper torso force applicator 131 and leg thrust and leg thrust force applicator 85. Appropriate variations in force applicator 18 can be made using the principles taught herein to provide a form of device 10 to exercise any desired group of muscles.

Upper torso device includes a torso frame 150, a torso chair 170 secured to torso frame 150, and weight stack 14 also secured to torso frame 150. Upper torso force applicator 131 is also secured to torso frame 150.

Torso force applicator 131 includes two symmetrical L-shaped sides 132. Each of the L-shaped sides 132 includes an upper arm support 133 substantially perpendicular to a hand bar support 134. At the end of hand bar support 134 opposite upper arm support 133 is secured hand bar 136. Arm rests 138 are mounted on each of upper arm support 133 and include L-shaped mounting flanges 140 bolted thereto. Arm pads 142 are secured in standard fashion to mounting flange 140. The upper arm of the torso device user rests on arm pads 142, while the user's hands grip hand bar 136.

Upper torso device 130 includes a torso frame 150, a torso chair 170 secured to torso frame 150, and a weight stack also secured to torso frame 150. Further, torso force applicator 131 is also secured to torso frame 150.

Torso frame 150 has a floor structure 152 which rests on the floor. Floor structure 152 is generally square or rectangular in shape with chair mounting bar 154 connecting two opposite sides of the floor structure 152 securely at the midpoints thereof. Protruding upwardly from forward corner 155 of the floor support 152 are torso pillars 156. In a similar fashion, rear torso pillars 158 protrude upwardly from rear corners 159. At the end of rear torso pillars 158 opposite rear corners 159, rear torso brace 160 connects rear torso pillars 158 and is parallel to chair mount 154 and is opposite floor structure 152.

Below rear torso brace 160, weight stack 14 is secured to floor structure 152. Substantially perpendicular to rear torso brace 160 and secured at either end thereof are a pair of side torso braces 162. Side torso braces 162 are connected at the other end thereof to front torso pillars 156 at the top thereof.

Torso chair 170 is secured to chair mount 154 at torso chair support 172. Torso seat 174 is secured to the top of torso chair support 172 and braced by torso seat brace 176 connected at one end to torso seat 174 and at the other end to torso chair support 172. Torso seat back 178 is secured to torso chair support 172.

Central upper brace 180 is secured between side torso braces 162 to add strength to the structure, and optionally may support torso seat back 178. Secured to central upper brace 180 and parallel to each of side torso braces 162 is a pair of axle supports 182. Axle support braces 184 securedly connect axle supports 182 to the junction of forward torso pillars 156 and side torso braces 162.

As is shown in FIG. V and FIG. VI, rotatably secured to axle supports 182 and side torso braces 162 are wheel axles 186. Secured to each of wheel axles 186 is a gear wheel 192, as a modified version of wheel 110. Secured to gear wheel 192 and off-center thereof is hydraulic cylinder 20. Meshing with gear wheel 192 is drive wheel 194, secured to drive axle 196. Also secured to drive wheel 194 is the end of upper arm support 133, which is opposite hand bar support 134.

Gear wheel 192 has a circumference of from about 1.8 to about 2.2 times that of drive wheel 194. More preferrably, gear wheel 192 has a circumference of about 1.9 to 2.1 times that of drive wheel 194. Most preferrably, the circumferential factor is about 2. This circumferential factor provides for the full torso exercise range. L-shaped sides 132 may move drive wheel 194 in arc of over 240°, which results in gear wheel 192 moving less than 180° and permits hyrdraulic cylinder 20 to function and lift weight stack 14.

A hydraulic cylinder 20 is secured to gear wheel 192 above described. Pivot end 22 is secured to rear torso pillar 158. Since there are two hydraulic cylinders 20 used here, the necessity of hose divider 36 may be eliminated and first weight stack hydraulic cylinder 42 may be connected to its own hydraulic cylinder 20, as can second weight stack hydraulic cylinder 44.

It is preferred, however, to feed both of hydraulic cylinders 20 into cross-connector 210 as shown in FIG. VII. Cross-connector 210 has intakes 212 from hydraulic cylinders 20 feeding into passage 214 and connected thereto in a secure hydraulic fashion. Likewise, fluid outtakes 216 are connected to the weight stack 14, each of outlet 216 being connected to a separate weight stack cylinder. In this fashion, fluid flow is equalized throughout the system.

Securing of parts to each other can be done in any suitable fashion. Welding and bolting are possible options. Welding is preferred because simpler assembly procedures are permitted. As can be seen, force applicator 18 varies with the muscles desired to be excerised. It is possible to run the hoses 32 within a frame of an exercise device. The connection and use of the hydraulic cylinder 20 to form a sealed closed hydraulic system provides for a simpler device structure for a type of device 10—no matter what group of muscles is desired to be exercised.

In operation, leg thrust device 74, as a variation of device 10, requires selecting the amount of weight to be lifted from weight stack 14, by using pin 69. As shown in FIG. III, weight stack 14 has a top weight 66 and lower weights 67. Lower weights 67 are slideably mounted on first weight hydraulic cylinder 42 and second weight hydraulic cylinder 44. Both first weight rod 52 and second weight rod 54 are secured in standard fashion to top weight 66 at their respective ends opposite weight plunger 50. Situated therebetween and also secured to top weight 66 is weight holder 70. Weight holder 70 has a series of holder apertures 72 which communicate with lower weight apertures 73. Pin 69 inserted in weight aperture 73 and holder aperture 72 determines the amount of weight to be lifted. The user (male or female) sits on leg thrust chair 84 and places each foot behind a foot support 20, and extends the legs. Lifting of the weight form weight stack 14 is accomplished by hydraulic connector 16 and the flow of hydraulic fluid therethrough. Camming action achieved by the connection of force rod 26 to wheel 110 provides for variable stress over the leverage over range of the muscle.

Upper torso device 130 operates in a fashion somewhat similar to leg extension device 74, with the major difference being in the upper torso force applicator 131. The respective upper arm of the user is placed on the appropriate pad 142 and the hand grips hand bar 136 and pulls downwardly lifting the appropriate amount of weight stack 14, in a fashion similar to leg extension device 74. Belt 90 holds the user in place and prevents circumvention of the exercise purpose.

By comparing leg extension device 74 and upper torso device 130, it can be seen that the primary differences are in the force applicator 18 and the differing supporting structure therefor. Thus it may be seen that a variation in the force applicator structure can result in the exercise of muscles as desired, with increased force applied as the muscle leverage increases.

The disclosure herein is sufficient to permit practice of this invention. Because of the sufficiency of this disclosure, various modifications may become apparent to those having ordinary skill in this. Such modifications are clearly covered hereby.

What is claimed and sought to secured by Letters Patent of the United States is:

1. A weight lifting device comprising a frame, said frame having secured thereto, a variable weight stack, a force applicator means for moving said variable weight stack, a connecting means for operably connecting said force applicator means to said variable weight stack so that movement of said force applicator means causes movement of a selected portion of said variable stack, wherein:

(a) said force applicator means is acted upon by a user during exercise of one or more groups of muscles;

(b) said variable weight stack includes a first weight and a second weight, said second weight adjustable and removable attachable to said first weight, said first weight is operably and directly connected to said connecting means:

(c) a hydraulic connector forming a part of the connecting means and comprises a hydraulic cylinder operatively connected to said weight stack; and (d) said connecting means including a hydraulic connecting means being connected at one end to said variable weight stack and at the other end to said force applicator means to thereby form a closed hydraulic circuit.

2. The weight lifting device of claim 1 wherein said force applicator means further includes a wheel and wherein said force applicator means has a pivot end and a wheel end, further wherein:

(a) said pivot end is pivotally secured to a member of said frame; and (b) said wheel end is rotatably secured to said wheel.

3. The exercise device of claim 2 wherein said force applicator means further includes:

(a) a hydraulic cylinder having hydraulic fluid therein;

(b) said pivot end being at one end of said hydraulic cylinder;

(c) an outlet adjacent said pivot end;

(d) said connecting means connected to said outlet;

(e) a force rod slideably mounted within said cylinder having a sealing means for separating a fluid chamber from a void chamber within said hydraulic cylinder and being secured at one end of said rod within said cylinder;

(f) said wheel end being at the other end of said force rod and outside cylinder;

(g) a fluid chamber being within said hydraulic cylinder and positioned between said sealing means and said outlet; and (h) a void chamber being between said sealing means and said wheel end, within said void cylinder is substantially free of said hydraulic fluid.

4. The weight lifting device of claim 3 wherein said connecting means is secured at the other end thereof to said weight stack to thereby transfer a force applied to said force applicator to said weight stack.

5. The exercise device of claim 4 wherein said device is used for exercising the frontal thighs or quadriceps of a user, said device further including;

(a) a base;

(b) a chair supportably secured to said base;

(c) said variable weight stack being secured to said base;

(d) a base pillar being secured at one end to said base, and having secured at the other end to said chair;

(e) a seat and a back for said chair;

(f) said other end of said base pillar being adjacent said for a applicator means; and (g) said pivot end of said cylinder being secured to said base pillar between said support pillar and the seat of said chair.

6. The weight lifting device of claim 5 wherein said force applicator comprises:

(a) a force bar secured at one end to said wheel and said force bar being secured at the other end to a foot support;

(b) said wheel being rotatably secured in a wheel notch in a front portion of said seat;

(c) said wheel end of said for applicator means being secured rotatably to said wheel off-center of said wheel axis;

(d) said wheel and said force bar being rotatably mounted with respect to an axle wheel having an axle; and (e) said axle being fixedly mounted within said wheel notch.

7. The weight lifting device of claim 6 wherein said force bar comprises:

(a) a first force piece secured to one side of said wheel;

(b) a second force piece secured to the other side of said wheel;

(c) said first force piece and said second force piece being parallel and symmetrically positioned with respect to the wheel; and (d) a spacer between said first force piece and said second force piece at a foot support.

* * * * *